United States Patent [19]

Park

[11] Patent Number: 5,006,042

[45] Date of Patent: Apr. 9, 1991

[54] APPARATUS FOR FEEDING BOARDS OR SHEETS FROM A STACK

[75] Inventor: Marcus G. Park, Stockport, England

[73] Assignee: Simon Container Machinery Limited, Cheshire, England

[21] Appl. No.: 463,346

[22] Filed: Jan. 10, 1990

[30] Foreign Application Priority Data

Jan. 18, 1989 [GB] United Kingdom ..... 8901055

[51] Int. Cl.[5] ..... B65G 59/00

[52] U.S. Cl. ..... 414/795.4; 198/577; 271/111; 271/114; 414/797.3; 414/797.7

[58] Field of Search ..... 271/35, 111, 112, 114, 271/165; 414/797.6, 797.7, 795.4, 796.9, 797, 797.2, 797.3, 797.8; 198/577

[56] References Cited

U.S. PATENT DOCUMENTS 4,045,015 8/1977 Sardella ..... 271/114 X
4,681,311 7/1987 Sardella ..... 271/35 X

FOREIGN PATENT DOCUMENTS 32185 5/1962 Finland ..... 414/797.7
8201560 2/1983 Netherlands ..... 271/35
2079260 1/1982 United Kingdom ..... 414/797.6

*Primary Examiner*—David A. Bucci
*Assistant Examiner*—Janice Krizek
*Attorney, Agent, or Firm*—Nies, Kurz, Bergert & Tamburro

[57] ABSTRACT

Apparatus for feeding boards in a single direction sequentially from the bottom (or top) of a stack through a feed gate, comprising three parallel rows of frictional contact conveying wheels (24) each row driven by a separate electric motor (21, 22, 23). The boards (12) are fed sequentially onto an output conveyor (1) without nip rolls. An electronic control system (27) accelerates the three rows of wheels (24) simultaneously to line speed and progressively decelerates each row of wheels when the trailing edge of each board has advanced and before the next succeeding board has descended. The conveying wheels (24) project through apertures in a suction box (16) which holds the boards in contact with the conveying wheels during conveyance. The boards are fed without crush accurately and in perfect register without slipping and with minimum power requirements.

11 Claims, 2 Drawing Sheets

APPARATUS FOR FEEDING BOARDS OR SHEETS FROM A STACK

Figure 1:
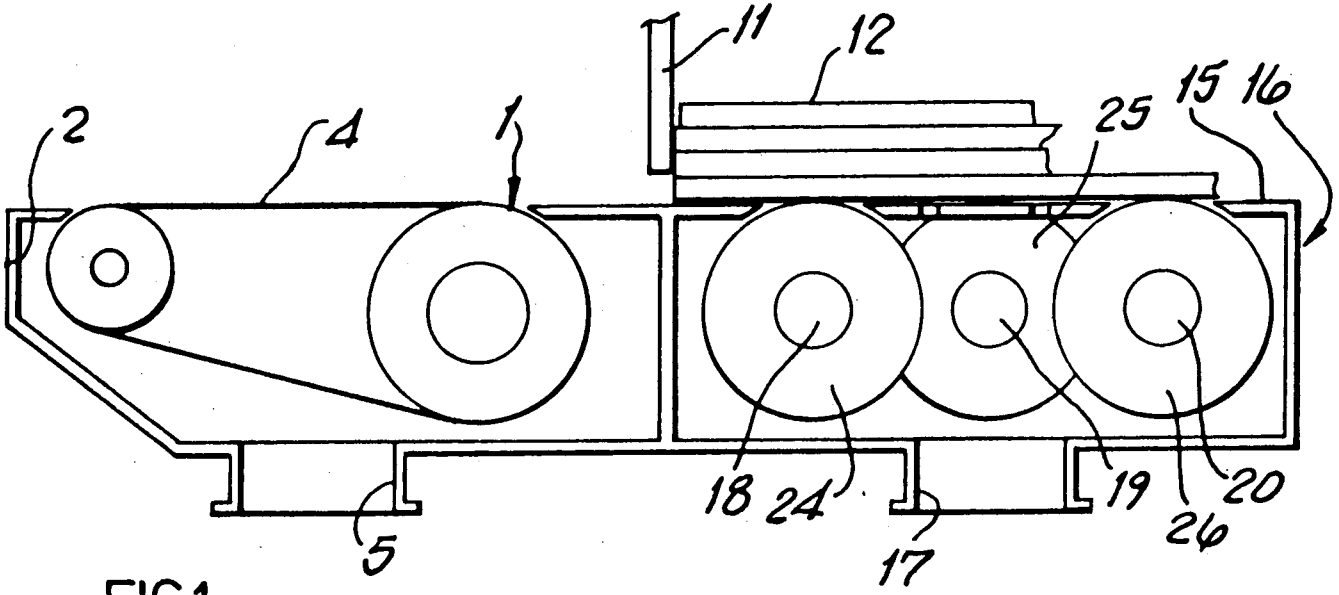

This invention concerns apparatus for feeding boards or sheets, for example paperboard blanks, from the top or from the bottom of a stack into, for example, corrugated board handling machinery such as printer slotters, box making machines and rotary die cutters.

Many devices have been proposed for positively feeding boards. These include kicker feeders in which a backstop moves forwardly to push each succeeding board through a feed gate, but such devices have the disadvantage that the feeder can damage the edge of a board and cannot therefore be used to feed corrugated cross flute blanks successfully. Another example is a suction box which frictionally holds each successive board and is driven in reciprocation to carry the latter forwardly into the machine. Such devices are mechanically complicated with a multiplicity of moving and wearing parts and the necessity to embody a high vacuum pump rendering the device expensive in manufacture and operation.

A still further example of prior art in this field are so-called lead edge feeders which employ high friction conveying means such as wheels, rollers or belts, and a high volume fan to produce vacuum hold down. Such devices usually include stack lifters with gear trains or cam arrangements to activate the lifters and the feed members.

An object of the present invention is to provide apparatus which efficiently and positively feeds boards without damage, consecutively from the top or bottom of a stack, and which does not require high vacuum hold down or accurate timing of board lifters. To ensure accurate register each board should undergo controlled acceleration to a pre-determined speed effectively without slipping and with minimum power requirements.

According to the present invention there is provided apparatus for feeding boards in a single direction sequentially from the top or bottom of a stack through a feed gate at the top or base respectively of a front stack retaining wall, comprising at least two rotary conveying members displaced longitudinally in the direction of feed and each having a conveying surface effective transversely across at least a part of the width of the boards to be fed and continuously in conveying contact with the most adjacent board in the stack, a separate variable speed motor to drive each conveying member selectively in said direction, suction means for holding each consecutive board in contact with the conveying members, and control means to start and accelerate the motors and their conveying members to a pre-determined speed to advance said most adjacent board and to decelerate each motor and its conveying members after the board has advanced and before the next succeeding board in the stack has descended onto a conveying surface.

Preferably there are three parallel conveying members displaced longitudinally in the direction of feed and each extending transversely across the apparatus, each conveying member being driven by a respective variable speed motor, said control means being adapted to start and accelerate the three motors simultaneously such that the three conveying surfaces grip a board to be fed by static friction and accelerate same to said pre-determined speed, and to decelerate the conveying members consecutively before the next succeeding board has descended onto the associated conveying surfaces.

Still further, each conveying member preferably comprises a transverse row of spaced conveying wheels mounted on a common shaft driven by one of said motors, each wheel being disposed within an aperture in a suction box such that the conveying surface of said wheel projects through said aperture to be in frictional drive contact with the adjacent board in a stack, the suction box containing perforations disposed between adjacent wheels thus to hold the board in frictional engagement with the latter.

Figure 2:
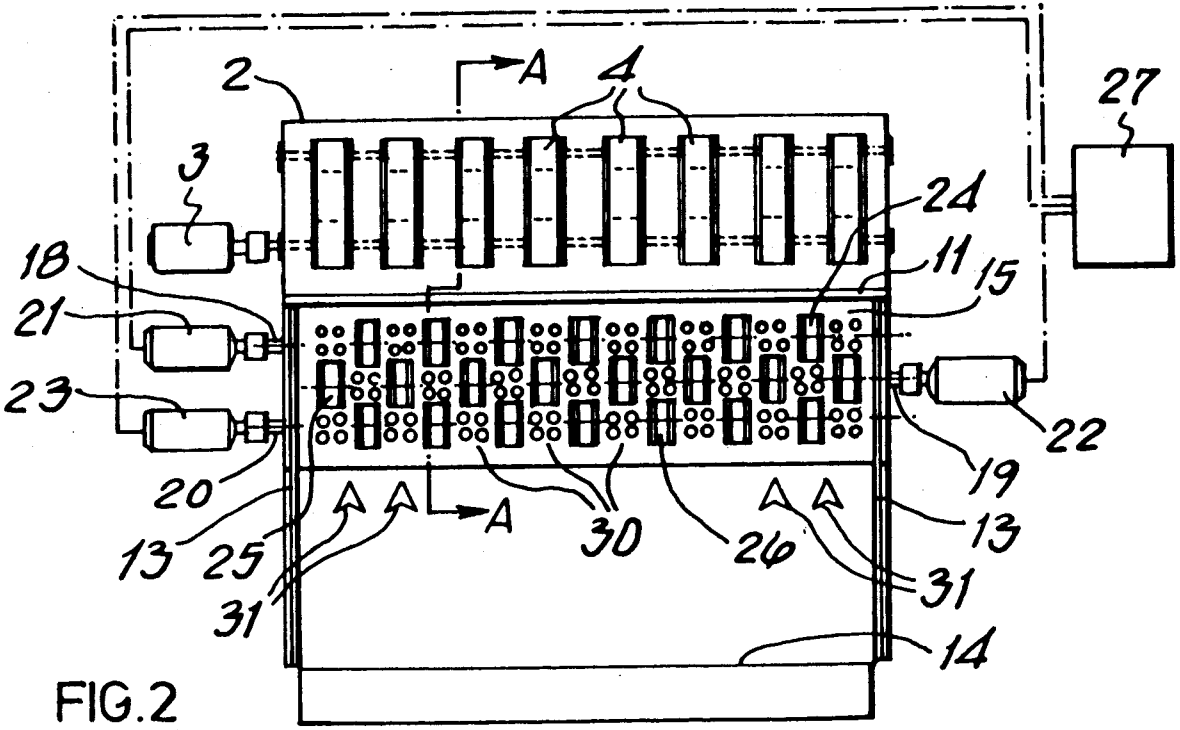

An embodiment of the invention will now be described, by way of example only, with reference to the accompanying schematic drawings in which:

FIG. 1 is a vertical section taken along line A—A of FIG. 2;

and FIG. 2 is a plan view of the apparatus of FIG. 1;

For the purpose of this description it will be assumed that the apparatus is designed to feed paperboard blanks from the bottom of a stack onto a conveyor 1 which forms the top of a housing 2 and is driven by a motor 3 in synchronism with a machine such as a die cutter (not shown). Beneath the conveyor 1 which may consist of a transverse array of parallel conveying belts 4, suction is applied at 5 to hold down blanks which traverse the conveyor 1.

In FIG. 1 there is also shown the base region of a front stack retaining wall 11 against which a stack 12 of blanks is located. The wall 11 forms part of a hopper which also includes adjustable side guides 13 and a backstop 14 as shown in FIG. 2. The stack rests above a perforated top plate 15 of a suction box generally indicated at 16. Suction is applied to withdraw air from the box at 17.

Rotatably mounted in the suction box are three shafts 18, 19 and 20 driven by motors 21, 22 and 23 and carrying parallel rows 24, 25 and 26 of spaced conveying wheels, the wheels being arranged in partial overlapping relationship when viewed axially as indicated in FIG. 2. Each wheel carries a frictional surface of rubber or plastics material.

As can be seen from FIG. 2 the plate 15 is perforated by groups of apertures 30 interposed between the wheels. Adjustable vents 31 are provided in one side wall of the box 16 to determine the amount of suction applied through the perforated plate 15.

An electronic control system generally indicated at 27 is provided to control operation of motors 21, 22, 23 as will be described.

In operation, with a stack of blanks 12 located in the hopper, the lowermost blank to be fed is in frictional contact with and rests upon the wheels 24, 25, 26, there being no other stack supporting means.

A start-up signal from the electronic control 27 starts and accelerates each of the three motors simultaneously from stationary to a pre-determined conveying speed. Thus, the conveying surfaces undergo controlled acceleration whereby the wheels 24, 25, 26 grip the bottom surface of the lowermost blank by static friction and feed it beneath a feed gate defined by the bottom of wall 11, and onto conveyor 1. The motors 21, 22, 23 continue to rotate at the predetermined speed until such time as the trailing edge of the blank passes over the wheels 26 of shaft 20 whereupon motor 23 is decelerated at a controlled rate to a stationary condition. Consecutively, motors 22 and 21 are also decelerated in the same manner. As the trailing edge of the blank advances towards the front of the stack, the next succeeding blank settles progressively onto the decelerating or stationary conveying surfaces of the wheels 24, 25, 26.

The electronic control 27 transmits operating signals to the motors 21, 22, 23 in a timed sequence determined by the length of the blanks and the line speed of the feed conveyor 1 so that the motors are restarted at a predetermined moment after the entire preceding blank has left the stack. In this way, the blanks are fed in perfect register with a predetermined gap between them or alternatively in effective abutting relationship.

An advantage of the apparatus of this invention is that it provides a positive and controlled transportation of the blanks without the need for lifting devices to raise and lower the stack onto the conveying surfaces, and this in turn enables the device to be used more readily for feeding blanks from the top of a stack in which case the conveying members and suction box are inverted and placed in operative contact with the top blank. In this case, means are provided progressively to lift the stack thus to maintain it in conveying contact with the wheels.

The absence of any nip roller above conveyor 1 ensures that the blanks are not crushed, the suction below the conveyor being sufficient to ensure positive drive to the blanks.

It is not intended to limit the invention to this example. Whilst the device operates most effectively with three rows of wheels arranged in partial overlapping relationship as illustrated in FIG. 2, in some cases two rows may be provided, and the conveying surfaces may be made up of single transversely extending conveying rolls instead of separate wheels.

Again, more than three independently controlled conveying members may be provided depending upon the length of blanks or boards to be fed.

The transverse extent of the suction box may vary according to the range of width of boards to be fed, and the box may be sectionalised transversely so that only a part of the width of the entire box may be selectively operated when feeding very narrow boards.

I claim:

1. Apparatus for feeding boards in a single direction sequentially from the top or bottom of a stack through a feed gate at the top or base respectively of a front stack retaining wall, comprising at least two rotary conveying members displaced longitudinally in the direction of feed and each having a conveying surface effective transversely across at least a part of the width of the boards to be fed and continuously in conveying contact with the most adjacent board in the stack, a separate variable speed motor to drive each conveying member selectively in said direction, suction means for holding each consecutive board in contact with the conveying members, and control means to start and accelerate the motors and their conveying members to a pre-determined speed to advance said most adjacent board and to decelerate each motor and its conveying members after the board has advanced and before the next succeeding board in the stack has descended onto a conveying surface.

2. Apparatus according to claim 1, including three parallel conveying members displaced longitudinally in the direction of feed and each extending transversely across the apparatus, each conveying member being driven by a respective variable speed motor, said control means being adapted to start and accelerate the three motors simultaneously such that the three conveying surfaces grip a board to be fed by static friction and accelerate same to said predetermined speed, and to decelerate the conveying members consecutively before the next succeeding board ha descended onto the associated conveying surfaces.

3. Apparatus according to claim 2, wherein each conveying member comprises a transverse row of spaced conveying wheels mounted on a common shaft driven by one of said motors, each wheel being disposed adjacent an aperture in a suction box such that the conveying surface of said wheel projects through said aperture to be in frictional drive contact with the adjacent board in a stack, the suction box containing perforations disposed between the wheels thus to hold the board in frictional engagement with the latter.

4. Apparatus according to any preceding claim, including a conveyor for receiving the boards after passage through the feed gate, and further suction means for holding each consecutive board in contact with said conveyor during conveyance thereon.

5. Apparatus according to claim 4, wherein said conveyor comprises a transverse array of parallel conveying belts forming the top of a housing from which suction is applied to hold down the consecutive boards during conveyance.

6. Apparatus according to claim 1, wherein said front stack retaining wall forms part of a hopper including adjustable side guides and a backstop.

7. Apparatus according to claim 3, wherein each conveying wheel carries a frictional surface of rubber or plastics.

8. Apparatus according to claim 3, wherein the suction box includes at least one adjustable vent to determine the amount of suction applied through said perforations.

9. Apparatus according to claim 1, wherein said control means is adapted to transmit operating signals to each variable speed motor in a timed sequence determined by the length of the boards to be conveyed and by said predetermined speed, such that the motors are restarted at a predetermined moment after the entire preceding board has left the stack.

10. Apparatus according to claim 3, wherein the three rows of said wheels are arranged in partial overlapping relationship when viewed axially.

11. Apparatus according to claim 1, wherein said suction means for holding each consecutive board in contact with the conveying member is sectionalised transversely such that the operative width of said suction means may be selected according to the width of boards to be fed.

* * * * *